United States Patent [19]

Takamatsu

[11] 4,428,080

[45] Jan. 31, 1984

[54] SLACKS

[75] Inventor: Noboru Takamatsu, Kaizuka City, Japan

[73] Assignee: Chikuma Apparel Co., Ltd., Japan

[21] Appl. No.: 282,745

[22] Filed: Jul. 13, 1981

[30] Foreign Application Priority Data

Jul. 23, 1980 [JP] Japan ..... 55-104899[U]

[51] Int. Cl.[3] ..... A41D 1/06; A41D 27/20; A41F 9/00

[52] U.S. Cl. ..... 2/227; 2/236; 2/247

[58] Field of Search ..... 2/236, 250, 247, 271, 2/220, 227

[56] References Cited

U.S. PATENT DOCUMENTS

| | | | |
|---|---|---|---|
| 1,027,904 | 5/1912 | Rogers | 2/247 X |
| 1,091,665 | 3/1914 | Kirshen | 2/247 X |
| 1,107,158 | 8/1914 | Day | 2/247 X |
| 1,210,359 | 12/1916 | Pixley | 2/247 X |
| 2,359,012 | 9/1944 | Sophier | 2/247 |
| 2,725,573 | 12/1955 | Kornhauser | 2/247 |

*Primary Examiner*—H. Hampton Hunter

*Attorney, Agent, or Firm*—Kane, Dalsimer, Kane, Sullivan and Kurucz

[57] ABSTRACT

The invention relates to a slacks comprising one or more pockets and a plurality of belt loops attached to the slacks at the height of the waist band. According to the invention the pocket opening of at least one pocket is arranged in the waist band in such a manner that during the wearing of the slacks the pocket opening is covered by a belt passed through the belt loops. In this manner, articles put in said pocket can not be lost or stolen, since pick-pocketing is substantially impossible.

2 Claims, 2 Drawing Figures

SLACKS

BACKGROUND OF THE INVENTION

The invention relates to a slacks comprising one or more pockets and a plurality of belt loops attached to the slacks at the height of the waist band.

When a person is simply dressed and wears no jacket as for example in summer, it is very difficult to keep by oneself important documents, as a passport or driving licence, and other valuable articles. The regular side pocket has insufficient space, whereas the back pockets are not safe enough.

SUMMARY OF THE INVENTION

It is an object of the invention to provide a slacks of the abovementioned type, wherein these disadvantages are obviated in a simple but nevertheless effective manner.

To this end, the slacks according to the invention is characterized in that the pocket opening of at least one pocket is arranged in the waist band in such a manner that during the wearing of the slacks the pocket opening is covered by a belt passed through the belt loops.

In this manner, the articles put in said pocket cannot be lost or stolen, since pick-pocketing is substantially impossible.

According to a favourable embodiment the belt loop arranged at the pocket opening is sewn to the slacks only at the lower side. Thereby, a good accessibility of the pocket is guaranteed.

BRIEF DESCRIPTION OF THE DRAWINGS

The invention is further described by reference to the drawing, in which an embodiment of the slacks according to the invention is shown.

DETAILED DESCRIPTION OF A PREFERRED EMBODIMENT

Figure 2:
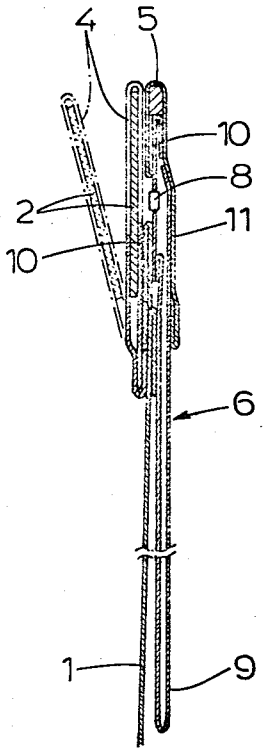
FIG. 2 is a cross-section according to the line II—II of FIG. 1 on a larger scale.
Figure 1:
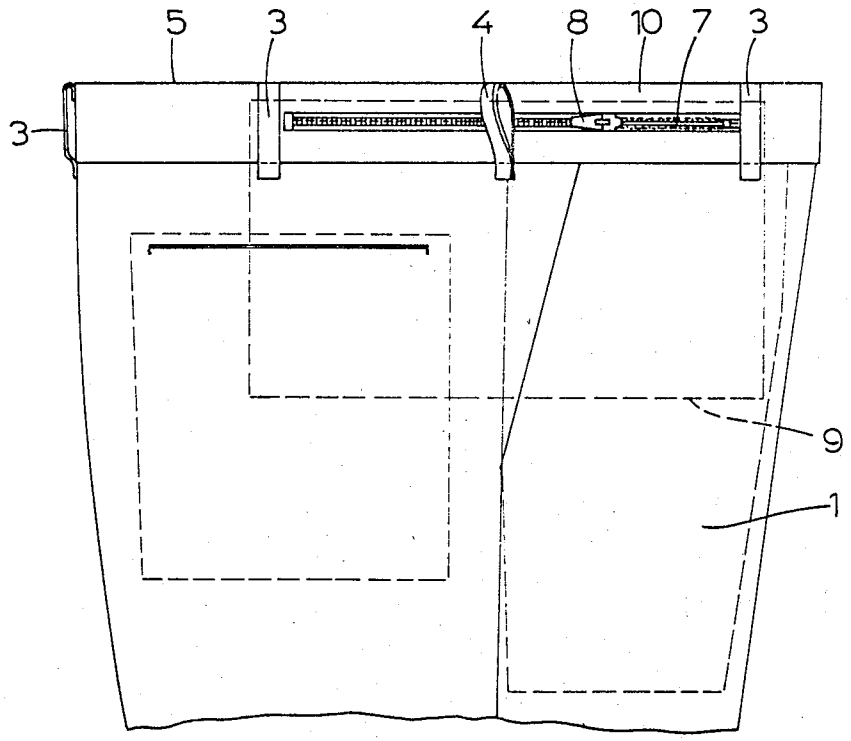
FIG. 1 is a partially shown side view of a slacks according to the invention.

In FIG. 1 a slacks 1 is shown, which slacks 1 can be worn with a belt 2 (see FIG. 2) passed through loops 3, 4, which are sewn to the slacks 1 at the height of the waist band 5. A pocket 6 is accessible through a pocket opening 7 arranged horizontally at a side of the slacks on the outside of the waist band 5. The pocket opening 7 can be closed by means of a zip-fastener 8. The pocket 6 is formed by attaching a pocketing 9 at the inner side against the waist band 5.

The waist band 5 is firmly sewn up by applying the interlining between the cloth 10 and the lining 11, such that even by applying the zip-fastener 8 in the pocket opening 7 in the waist band 5 the shape will not be distorted. As appears from the FIGS. 1 and 2 the pocket opening 7 is formed in the cloth 10 of the waist band 5, while the pocketing 9 is attached at the inner side. In this manner, the pocket opening 7 is always covered by the belt 2.

Therefore, articles which have been put in the pocket 6 cannot be lost or stolen, since pick-pocketing is substantially impossible.

Because the pocket opening 7 is formed at the outside of the waist band 5, inserting or extracting articles from the pocket 6 can be easily done by loosening the belt 2 a little. Thereby, the insertion or extraction of articles can be more easily done than by using the stomach band.

To improve the accessibility of the pocket the belt loop 4 placed over said pocket 6 is only sewn at the lower side, whereby more space is obtained between the belt loop 4 and the pocket opening 7. The putting in or taking out of articles can now be done without loosening the belt 2, while the pocket opening 7 is still always covered by the belt 2.

The invention is not restricted to the embodiment described which can be varied in several ways within the scope of the invention.

I claim:

1. Slacks comprising one or more pockets and a plurality of belt loops attached to the slacks at the height of the waistband, wherein the pocket opening of at least one pocket is arranged in the waist band between two loops and an intermediate loop which is positioned between said two loops being sewn to the slacks only at the lower side whereby during the wearing of the slacks the pocket opening is covered by a belt passed through the belt loops.

2. Slacks according to claim 1, wherein the pocket opening can be closed by a zip-fastener.

* * * * *